US006455987B1

(12) United States Patent
Durst et al.

(10) Patent No.: US 6,455,987 B1
(45) Date of Patent: Sep. 24, 2002

(54) ELECTRON MULTIPLIER AND METHOD OF MAKING SAME

(75) Inventors: Roger Durst, Middleton; Yacouba Diawara, Madison, both of WI (US)

(73) Assignee: Bruker Analytical X-Ray Systems, Inc., Madison, WI (US)

( * ) Notice: Subject to any disclaimer, the term of this patent is extended or adjusted under 35 U.S.C. 154(b) by 0 days.

(21) Appl. No.: 09/228,375

(22) Filed: Jan. 12, 1999

(51) Int. Cl.[7] ..... H01J 43/00

(52) U.S. Cl. ..... 313/103 R; 313/399; 313/532; 313/528; 250/207

(58) Field of Search ..... 313/532, 539, 313/533, 103 R, 104, 105 R, 495, 496, 497, 498, 502–512; 250/207

(56) References Cited

U.S. PATENT DOCUMENTS 5,624,706 A 4/1997 Goukassian

OTHER PUBLICATIONS

Harold Jacobs et al., The Mechanism of Field Dependent Secondary Emission; Physical Review, vol. 88, No. 3; Nov. 1, 1952; pp. 492–499.

G. W. Goetze et al., Field–Enhanced Secondary Electron Emission from Films of Low Density; Journal of Applied Physics, vol. 35, No. 3 (Two Parts—Part 1); Mar. 1964; pp. 482–489.

E. L. Garwin et al., Mechanism of Secondary Emission and Single–Particle Statistics from Low–Density Films of Alkali Halides; Journal of Applied Physics, vol. 41, No. 4; Mar. 15, 1970; pp. 1489–1496.

M. P. Lorikian et al., The Investigation of Controllable Secondary Electron Emission from Single Particles; Nuclear Instruments and Methods 122 (1974); North–Holland Publishing Co.; pp. 377–382

M. P. Lorikyan et al., Particle Detection by Means of Controllable Secondary Electron Emission Method; Nuclear Instruments and Methods 140 (1977); North–Holland Publishing Co.; pp. 505–509.

S. M. Gukasian et al., Investigation of the Dielectric Particle Detector; Nuclear Instruments and Methods 167 (1979); North–Holland Publishing Co.; pp. 427–430.

V. G. Gavalyan et al., Multiwire Emission Detector; Erevan Physics Institute, Erevan Polytechnical Institute; pp. 861–863.

(List continued on next page.)

*Primary Examiner*—Nimeshkumar D. Patel
*Assistant Examiner*—Mariceli Santiago
(74) *Attorney, Agent, or Firm*—Kudirka & Jobse, LLP

(57) ABSTRACT

An electron multiplication apparatus uses a matrix of dielectric particles interspersed with conductive particles. Typically a porous layer of metal oxide and relatively inert metal, the material provides high electron count rates while maintaining good temperature stability. The layer is located between a cathode and an anode that together provide desired voltage differentials. A mesh is also used on a side of the matrix layer opposite the cathode to conduct surface charge away from the matrix, while providing an intermediate voltage potential between that of the anode and the cathode. A voltage source is used to generate the voltage potentials for each of the anode, cathode and mesh layer, and the resulting electric fields provide a device that may be used in the detection of high energy particles and photons, such as x-rays. A preferred method of fabricating the material involves the codeposition of a metal prone to oxidation and a relatively inert metal to form a porous layer. A subsequent oxidization step results in a metal oxide being intermingled with a conductive material. The resulting matrix has a high counting rate, but maintains a negative temperature coefficient.

17 Claims, 2 Drawing Sheets

OTHER PUBLICATIONS

S. M. Gukasian et al., Dielectric Particle Detector under Pulsed Power Supply; Nuclear Instruments and Methods 171 (1980); North–Holland Publishing Company; pp. 469–472.

V. G. Gavalyan et al., Electron Multiplication in Controlled Secondary Electron Emission; Sov. Phys. Tech. Phys. 28(8); Aug. 1983; pp. 996–998.

Applied Optics, vol. 25, No. 14; Jul. 15, 1986; pp. 2442–2445.

M. P. Lorikian et al., Multiwire Dielectric X–ray Detector; Nuclear Instruments and Methods in Physics Research; A 340 (1994); pp. 625–626.

D. F. Anderson et al., Low–Pressure Micro–Strip Gas Chamber and a Search for a High–Efficiency Secondary–Electron Emitter; Nuclear Physics B (Proc. Suppl.) 44 (1995); pp. 213–217.

Ping Sheng; Low–Field and High–Field Hopping Conduction in Granular Metal Films; pp. 143–151.

Victor E. Henrich et al., High–Efficiency Secondary–Electron Emission from Sputtered MgO–Au Cermets; Appl. Phys. Lett., vol. 23, No. 1; Jul. 1, 1973; pp. 7–8.

J. J. Hauser; Electrical and Structural Properties of Amorphous Metal–Metal Oxide Systems; Physical Review B, vol. 7, No. 9, May 1, 1973; pp. 4099–4111.

ELECTRON MULTIPLIER AND METHOD OF MAKING SAME

FIELD OF THE INVENTION

The invention relates generally to the field of electromagnetic signal detection and, more particularly, to signal detection using photon-counting detectors.

BACKGROUND OF THE INVENTION

Microchannel plates (MCP) have found a wide range of application as photon-counting or particle-counting detectors for science, industry and medicine. In general, these detectors provide excellent sensitivity and dynamic range. However, MCP detectors are limited in their counting rate capability by the physics of an electric recharging process within the detector. The functionality of a MCP detector is such that an incident particle at the input of the MCP causes an avalanche multiplication process that leaves the MCP channels with a local net positive charge. This charge must be neutralized by current conduction through the walls of the MCP channels before the next avalanche discharge can occur. The time for this neutralization, i.e., the recharge time, is given by:

$$\propto\tau\ R_{ch}C_{ch}$$

where $R_{ch}$ and $C_{ch}$ are the resistance and capacitance, respectively, of the MCP channels. At local count rates higher than about $0.3/\tau$ the microchannels do not have time to recharge after an avalanche and the gain strongly decreases.

Since the permittivity and geometry of the device effectively fix the capacitance of the channels, use of the detector at high count rates requires that the channel resistance be decreased. Special microchannel plates that are doped for high conductivity are available for high count rate applications. However, a fundamental difficulty arises with the use of these devices. Because microchannel plates are constructed of semiconducting glass with a negative temperature coefficient of resistance, as the temperature of the channels increases their resistance decreases. The power that is dissipated in the MCP channel by the dark current is given by:

$$P = \frac{V^2}{R_{ch}(T)}$$

where V is the voltage applied to the MCP (which must be fixed to maintain a constant gain) and T is the temperature of the device. As can be seen, at high count rates, local heating of the MCP channel occurs which reduces the channel resistance. This, in turn, further increases the dark current power dissipation. Thus, a positive feedback effect can continue to drive up the power and temperature of the MCP. Above a certain threshold, thermal runaway can occur in which the MCP channels are locally melted, resulting in the destruction of the MCP.

Because of the thermal runaway effect, high conductivity MCPs are typically limited to operation at counting rates of less than $10^5$ counts/mm$^2$/sec. The counting rate can be increased to a counting rate on the order of $10^6$ counts/mm$^2$/sec if a cooling plate is attached directly to the face of the MCP. However, doing so significantly reduces operational flexibility. The counting rate limitations on MCPs make their use in photon-counting impractical for a number of important high flux applications such as x-ray crystallography, medical diagnostic imaging and electron microscopy. Thus, analog imaging techniques are currently used for these applications. However, these methods are necessarily limited in sensitivity and dynamic range. Therefore, it would be desirable to have a detector with gain characteristics similar to conventional MCPs but with the ability to count at much higher rates.

SUMMARY OF THE INVENTION

In accordance with the present invention, an energy conversion apparatus is provided that uses a porous matrix of dielectric material intermingled with a metallic conductor. In the preferred embodiment, the matrix is an electron multiplication apparatus and has a zero or slightly positive temperature coefficient of resistance, and therefore remains thermally stable at high count rates. The material also exhibits a high secondary electron emissivity, as is required for an effective electron multiplier. In the preferred embodiment, the dielectric material has a large bandgap that allows warm electrons to travel for long distances through the material lattice without energy loss via electron-electron scattering. Because of the large bandgap, the dielectric, if used alone, would have a very low electron conductivity. In such a case, the dominant conductivity in this material would be thermally activated ion conductivity, which would result in a negative temperature coefficient. However, the matrix of the present invention uses high electron conductivity fragments intermingled with the dielectric material. This results in a material having significant quantum tunneling electron conductivity to prevent a negative temperature coefficient of resistance, and thermal runaway is thereby avoided.

The general components of an electron multiplication device using the matrix layer of the present invention include a conductive cathode and a conductive anode, with the matrix material located between them. A voltage source provides a voltage differential across the anode and cathode, resulting in an electric field in the region of the matrix layer. The matrix material, in general, is a porous combination of a dielectric material interspersed with fragments having a relatively high electrical conductivity. In the preferred embodiment, the dielectric is a material with a high secondary electron emissivity. For example, in one embodiment of the invention the dielectric is a metal oxide, such as an alkaline earth oxide, while in another the dielectric is an alkali halide. Preferably, the dielectric material is made up of particles having an average length of one to five microns. The conductive fragments are preferably a relatively inert metal, and have an average length of less than one micron. Also, the matrix preferably has pores with an average length of between five and ten microns.

In the preferred embodiment, the device also comprises a conductive material in contact with the side of the matrix layer toward the anode of the device. Typically, an air gap exists between the matrix layer and the anode, and the conductive material resides in conductive contact with the matrix. In one particular embodiment, the conductive material is a mesh that provides an electrical return to the cathode. This electrical contact between the cathode and the opposite side of the matrix prevents a polarization of the matrix layer and a corresponding reduction of the net electric field within the matrix layer to zero. Such a polarization would otherwise inhibit the production of secondary electrons within the matrix layer.

Fabrication of the matrix material can be done in different ways. In the preferred embodiment, a substrate is provided, and is located in the vicinity of an oxidizable metal and the relatively inert metal. The two metals are first degassed, and are then both vaporized such that they are codeposited on the substrate, interspersed in a porous layer. Use of an inert gas atmosphere during the vaporization stage provides the desired pores in the deposited layer. The porous, bimetallic matrix is then baked in an oxidizing atmosphere so as to oxidize the oxidizable metal. This produces a metal oxide dielectric with high secondary electron emissivity, interspersed with the fragments of high electron conductivity. The matrix is then located between the anode and cathode of the desired device, the cathode preferably serving as the substrate as well. In an alternative embodiment, the layer is formed by first combining the oxidizable material and the conductive material with an evaporable host material. The host material may be, for example, a combination of amyl acetate and magnesium carbonate. The combination of the host material and two matrix materials are applied to the substrate to a desired thickness, and the host material is then heated and decomposed, leaving behind the matrix layer.

DETAILED DESCRIPTION OF THE PREFERRED EMBODIMENTS

Figure 1:
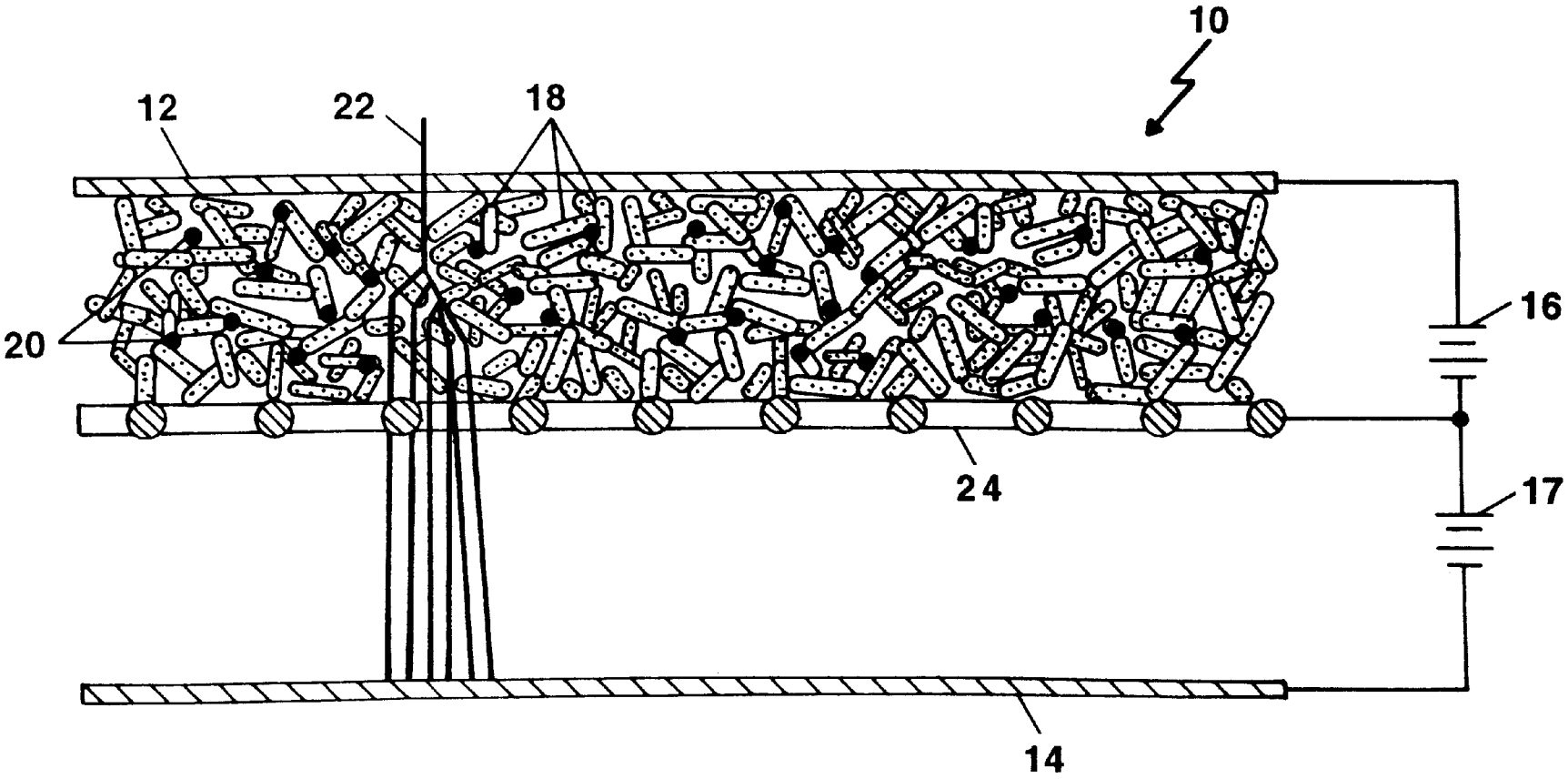
FIG. 1 is a schematic view of a detection apparatus according to the present invention.

FIG. 1 is a schematic view of a photon counting detector 10 according to a preferred embodiment of the invention. In this embodiment, the detector is configured for use in detecting x-rays, making it appropriate for analysis techniques such as x-ray diffraction. A cathode 12 of the detector is a conductive, x-ray transparent material, such as beryllium, aluminized polyester or aluminum foil. An anode 14 is located opposite the cathode, and is a material that is conductive and collects electrons, allowing their conversion to a detectable current. A preferred anode structure, for example, is made up of two orthogonal serpentine delay lines. This type of structure is known in the art, and will not be discussed in any further detail herein. A voltage differential on the plates 12, 14 is provided by voltage sources 16, 17 and is typically in the range of 500–800 V, the specific amount depending on the desired gain.

Located between the cathode 12 and anode 14 is an active layer of the detector 10. This layer consists of a porous matrix of dielectric material intermingled with fragments of a material having a good electron conductivity. In the preferred embodiment, the matrix has particles 18 of dielectric material having an average size of 1–2 microns. Interspersed with the dielectric particles 18 are metal particles 20, having an average diameter of 0.1 microns. While these are the relative proportions of the matrix materials in the preferred embodiment, those skilled in the art will recognize that variations in the size and mix of particles may also provide the desired effect.

In the configuration of FIG. 1, an electric field is applied to the matrix material by virtue of a voltage differential across the region in which the material resides. Although the anode 14 and cathode 12 together define a voltage potential between them, it is desirable to avoid polarization of the matrix material. Therefore, in the preferred embodiment, a conductive mesh 24 is placed in contact with a surface of the matrix layer that faces the anode 14. In the preferred embodiment, the mesh is a simple cross-hatch of conductive material, although other structures may also be used. The mesh is electrically returned to the voltage source 16, such that a circuit path is defined between the mesh 24 and the cathode 12. This prevents a polarizing charge buildup on the surface of the matrix layer, which might otherwise reduce the net electric field within the matrix layer. Thus, two different voltage differentials are defined by the structure, one across the matrix layer, and one across the gap between the mesh 24 and the anode 14. In the preferred embodiment, the field across the matrix material is approximately 100 V, while the field across the gap is approximately 400–700 V. Those skilled in the art will recognize that these values may be different depending on the construction of the device and the desired level of operation. Furthermore, for simplicity, the different electric field regions are shown in FIG. 1 as being provided by two voltage sources 16, 17. It will nevertheless be apparent that a simple implementation of the desired voltage differentials would be through the use of a single voltage source and a resistive voltage divider.

The basic mechanism of electron multiplication in porous dielectrics is well understood in the art, and will not be described in any further detail herein. With an electric field applied, an incident electron (or other particle or photon) can induce an avalanche secondary electron multiplication within the matrix material. However, it is notable that conventional porous dielectric detectors suffer from the same rate limitations as microchannel plates. In the present embodiment, the metal particles 20 are randomly interspersed throughout the porous dielectric matrix. These particles are highly conductive, and have a diameter of less than 1 $\mu$m. These small metal particles 20 only slightly decrease the effective secondary electron emissivity. However, they have a profound effect on the electron conductivity. The presence of the metal particles 20 allows hopping conduction (that is, electron quantum tunneling) between the metal particles which greatly increases the electron conductivity of the matrix layer, as compared to a pure dielectric layer.

An example of an electron multiplication within the detector 10 is given by the graphic depiction of the path 22 of an incident x-ray photon, and the ensuing electron multiplication. As shown, an incident x-ray photon passes through the surface of cathode 12, and enters the matrix layer where it is absorbed. The absorption of the high-energy photon results in the emission of a high-energy electron that propagates through the matrix. With the strong electric field across the matrix material, multiple secondary electrons are generated as the initial electron encounters more of the dielectric material. These secondary electrons themselves cause the generation of more secondary electrons, and the amplification process continues. A separation is provided between the matrix layer and the anode 14 that allows spreading of the electron cloud that emerges from the matrix. This spreading improves the spatial distribution of the signal detected on the anode. In the preferred embodiment, this gap is about seventy percent of the distance between the cathode and anode.

In a high electric field environment, the conductivity of the matrix is independent of temperature. A high-field environment may be defined as:

$$\frac{kT}{eEd} << 1$$

where kT is the thermal energy of the electrons, E is the applied electric field, d is the mean separation of the metal particles and e is the electron charge. In such a case, the electrical conductivity σ of a matrix according to the present invention may be written as:

$$\sigma \propto e^{\frac{C}{eEd}}$$

where C is the average effective capacitance of a pair of metal particles. Thus, the electrical conductivity is independent of the temperature and can be controlled either by adjusting the electric field or by selecting the separation of the metal particles. This result is appropriate since, as mentioned above, conductivity in the matrix occurs by quantum tunneling between adjacent metal particles, rather than by ion conduction. Moreover, in the high field environment, the quantum tunneling rate is determined by the electric field, since thermally activated tunneling is negligible.

For particle sizes on the order of 1–2 microns, the matrix can be considered to be in a "high field environment" for electric fields on the order of $10^3$ V/cm or higher. This field range is also appropriate for secondary electron amplification. Thus, in the electric field range given, the detector 10 will provide the desired response while still exhibiting a zero temperature coefficient of resistance, thereby avoiding thermal runaway. Depending on the concentration of metal particles and the applied electric field the matrix layer will have an electrical resistance that is approximately 3 to 5 orders of magnitude lower than high conductivity microchannel plates. Thus, the detector allows extremely high counting rate operation.

Figure 2:
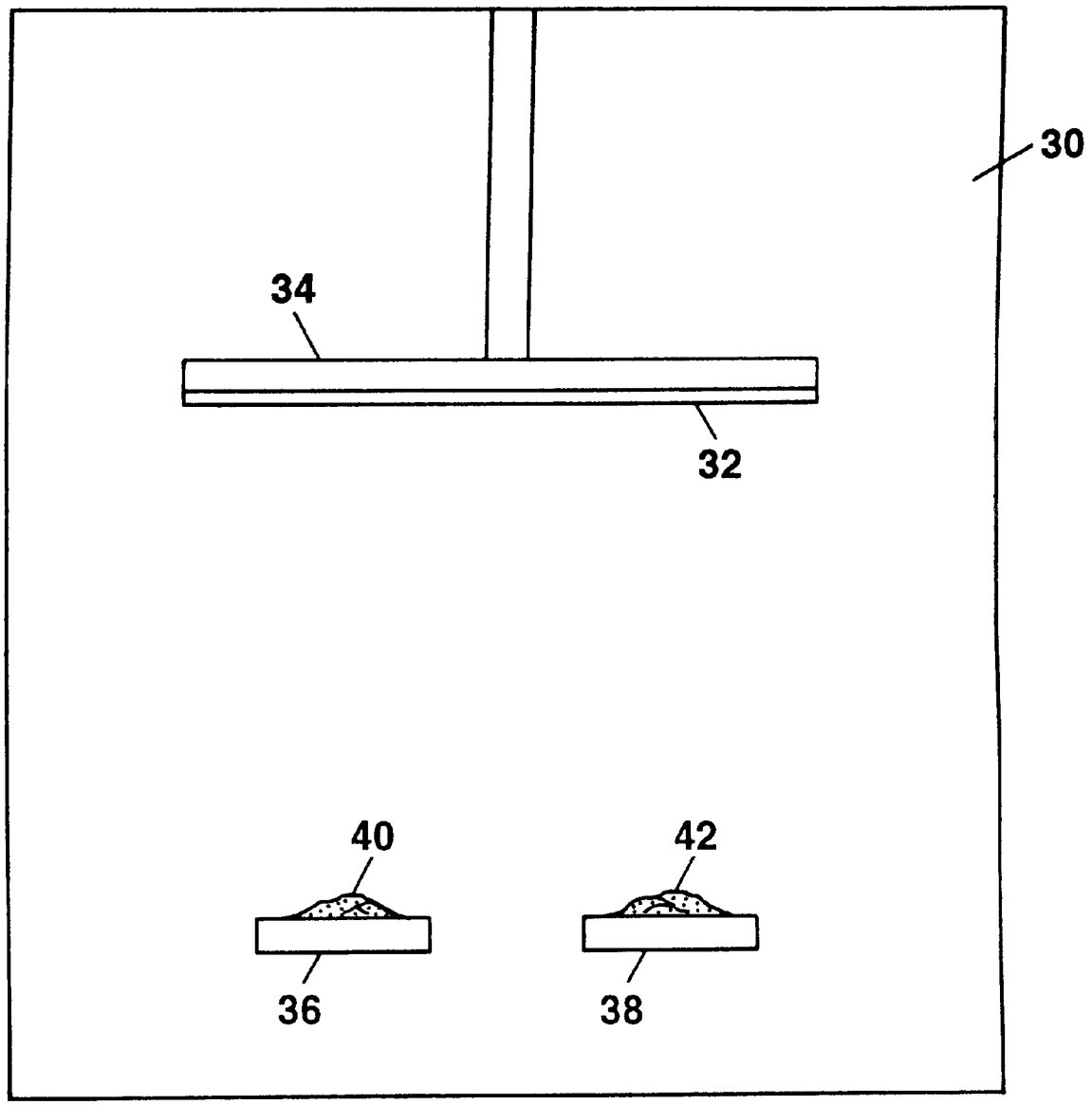
FIG. 2 is a schematic view of an apparatus for constructing a matrix material suitable for the construction of electron counting detectors according to the present invention.

In the preferred embodiment, construction of the matrix layer is done using physical vapor codeposition under an inert gas. This method is demonstrated by the schematic diagram of FIG. 2. As shown, a substrate 32 to be coated is placed in a vacuum chamber 30. In the preferred embodiment, the substrate is the cathode of the detector or, more likely, a larger piece of cathode material that is later divided into a number of different cathodes. The substrate 32 is supported on a rotation stage 34. Also located within the vacuum chamber are two evaporation boats 36, 38, each at a distance of about 10–15 cm from the substrate 32. Each of the evaporation boats holds a different one of two metals to be deposited on the substrate. A first of these is an easily oxidized metal 40, such as magnesium or aluminum, and the second is a relatively inert metal 42, such as gold or silver. As described below, codeposition of these two materials provides the desired matrix structure.

Once the metals 40, 42 are located in their respective evaporation boats, a high vacuum is drawn in vacuum chamber 30 (preferably below $10^{-6}$ torr). The evaporation boats 36, 38 are then heated so that each brings the metal it carries to a temperature close to its melting point, resulting in degassing by the high vacuum. The vacuum chamber 30 is then filled with an inert gas such as argon to a pressure of approximately 0.01–0.1 torr. The temperature of each of the evaporation boats 36, 38 is then increased to about 50–100 degrees above its respective melting temperature to begin vapor deposition. During this time, the rotation stage 34 is rotated at approximately 1–10 rpm. This ensures even coating of the substrate throughout the deposition process.

During the deposition process, collisions between the ambient gas and the metal vapors cause the metals to be deposited on the substrate 32 as a porous matrix of small (1–3 micron) crystallites. Deposition continues until a layer is formed on the substrate that is approximately 0.5 mm thick. After the deposition is complete, the deposited layer is annealed at 400–500 C for about 1 hour in an oxide-forming atmosphere, preferably oxygen or air. This causes the oxidization of the crystallites of metal 40, resulting in a porous layer of dielectric material having high secondary electron emissivity. If the metal 40 is aluminum, for example, a porous layer of $Al_2O_3$ results, while if the metal 40 is magnesium, the porous layer is MgO. Meanwhile, the deposited particles of metal 42, which is more resistant to oxidation, remains essentially in its original form, e.g., particles of gold or silver. In the preferred embodiment, the deposited layers will have a final density of about 2–5% of their solid density, in order to show good electron amplification capabilities.

As shown in FIG. 1, this fabrication method provides a random matrix of metal oxide crystals having typical sizes of 1–2 microns, interspersed with smaller metal particles (approximately 0.1 micron). Due to the random nature of the deposition, the resulting matrix also has a number of pores larger than the average crystal size. It is believed that the amplification process mainly occurs in these relatively large (5–10 micron) cavities, since they allow the electrons to acquire at least 10–20 eV of energy, considered necessary to produce a net gain in secondary electrons.

In an alternative fabrication embodiment, particles of magnesium oxide (MgO), magnesium carbonate ($MgCO_3$) and gold (Au) are mixed together into an amyl acetate host. This mixture is then applied uniformly to a desired substrate and heated under a vacuum (preferably less than $10^{-5}$ torr.), to about 500–600 C. This causes decomposition of the amyl acetate and the $MgCO_3$, and leaves behind a porous matrix of MgO and Au. Those skilled in the art will recognize that other comparable materials may also be substituted for those described herein.

While the invention has been shown and described with reference to a preferred embodiment thereof, it will be recognized by those skilled in the art that various changes in form and detail may be made herein without departing from the spirit and scope of the invention as defined by the appended claims. For example, by lowering the voltage differential across the matrix layer, the structure of FIG. 1 may be used as a photocathode instead of a multiplier. Although there is little or no electron multiplication in this embodiment, a photocathode results that has relatively fast operation as compared with conventional photocathodes. Furthermore, if an alkali halide material were used as the dielectric of the matrix layer, no oxidation step would be necessary during the fabrication of the device.

What is claimed is:

1. An electron multiplication apparatus comprising:

a conductive cathode;

a conductive anode proximate to the cathode;

a voltage source providing a voltage differential between the anode and cathode so as to create an electric field between them; and a matrix layer located within the electric field, the matrix layer comprising a porous combination of dielectric material interspersed with fragments having a high electron conductivity.

2. Apparatus according to claim 1 wherein the cathode is transparent to x-ray radiation.

3. Apparatus according to claim 1 wherein the cathode is substantially parallel to the anode.

4. Apparatus according to claim 1 wherein the dielectric material comprises a metal oxide.

5. Apparatus according to claim 1 wherein the dielectric material comprises an alkali halide.

6. Apparatus according to claim 1 wherein the dielectric material comprises particles having an average length of between one and five microns.

7. Apparatus according to claim 1 wherein the conductive fragments comprise a metal.

8. Apparatus according to claim 7 wherein the metal is inert.

9. Apparatus according to claim 1 wherein the conductive fragments comprise particles having an average length of less than one micron.

10. Apparatus according to claim 1 wherein the dielectric material and the conductive fragments each comprise a plurality of particles, and wherein the porous matrix has pores the average size of which are larger than the average size of either the dielectric particles or the highly conductive particles.

11. Apparatus according to claim 1 wherein the porous matrix has pores the average size of which are between five and ten microns.

12. Apparatus according to claim 1 further comprising a conductive path between the cathode and a surface of the matrix layer opposite the cathode.

13. Apparatus according to claim 12 wherein the conductive path comprises a conductive mesh in electrical contact with the surface of the matrix layer opposite the cathode.

14. Apparatus according to claim 1 wherein the voltage source provides a plurality of voltage differentials, a first differential existing between the cathode and a surface of the matrix layer opposite the cathode, and a second differential existing between the anode and the surface of the matrix layer opposite the cathode.

15. Apparatus according to claim 14 further comprising a conductive material in electrical contact with the surface of the matrix layer opposite the cathode.

16. Apparatus according to claim 15 wherein the conductive material comprises a conductive mesh adjacent the surface of the matrix layer opposite the cathode, the mesh having a voltage potential between a voltage potential of the anode and a voltage potential of the cathode.

17. An electron multiplication apparatus comprising:

a conductive cathode that is transparent to x-rays;

a conductive anode substantially parallel to the cathode;

a voltage source providing a voltage differential between the anode and cathode so as to create an electric field between them;

a matrix layer located within the electric field, the matrix layer comprising a porous combination of metal oxide dielectric particles interspersed with highly conductive metal particles; and a conductive layer adjacent to a side of the matrix layer opposite the cathode, the conductive layer having a voltage potential between a voltage potential of the anode and a voltage potential of the cathode.

* * * * *